US006098253A

United States Patent [19]

Nishida et al.

[11] Patent Number: 6,098,253

[45] Date of Patent: Aug. 8, 2000

[54] TAG FASTENER

[75] Inventors: Yasutaka Nishida, Macon, Ga.; Ryoichiro Uehara, Toyama, Japan

[73] Assignee: YKK Corporation of America, Marietta, Ga.

[21] Appl. No.: 09/146,660

[22] Filed: Sep. 3, 1998

[51] Int. Cl.[7] ..... B65D 55/06

[52] U.S. Cl. ..... 24/429; 24/16 PB; 292/320; 292/318

[58] Field of Search ..... 24/16 PB, 429, 24/326, 543; 40/1.5, 665, 669; 292/318, 307 A, 322, 320

[56] References Cited

U.S. PATENT DOCUMENTS

| | | | |
|---|---|---|---|
| 3,834,748 | 9/1974 | Lonnee | 24/16 PB X |
| 4,038,725 | 8/1977 | Keefe | 24/150 |
| 4,059,300 | 11/1977 | Moberg et al. | 24/16 PB X |
| 4,106,802 | 8/1978 | Lozio | 292/320 |
| 4,183,567 | 1/1980 | Bone | 292/318 |
| 4,248,462 | 2/1981 | Choi | 292/322 |
| 4,299,417 | 11/1981 | McClure | 292/320 |
| 4,501,049 | 2/1985 | Adamson | 24/16 PBB X |
| 4,588,218 | 5/1986 | Guiler et al. | 24/16 PB X |
| 4,676,535 | 6/1987 | Mautner | 24/16 BP X |
| 4,680,836 | 7/1987 | Wisecup | 24/16 PB X |
| 4,793,641 | 12/1988 | Sokol | 292/307 A |
| 5,189,761 | 3/1993 | Chisholm | 24/16 PB |
| 5,535,491 | 7/1996 | Allport | 24/429 |
| 5,568,952 | 10/1996 | Ruegg | 292/318 |
| 5,765,885 | 6/1998 | Netto | 292/318 |

*Primary Examiner*—Anthony Knight
*Assistant Examiner*—Robert J. Sandy
*Attorney, Agent, or Firm*—Finnegan, Henderson, Farabow, Garrett & Dunner, LLP

[57] ABSTRACT

A one-piece, tamper-resistant fastener for attaching one item to another is described. The fastener is particularly suited for attaching an item such as a ski coupon to a skier's garment. The attachment mechanism of the fastener is designed to allow a user to attach both items to the fastener, and thus the items to each other, in one action. The fastener is made of a single piece of plastic material, preferably polypropylene, which is easily recycled, even with a typical ski coupon attached. The one-piece fastener may alternatively be made using a biodegradable material.

10 Claims, 4 Drawing Sheets

TAG FASTENER

FIELD OF THE INVENTION

The present invention relates generally to a fastener for securing an article to an object, and particularly, to a fastener for securing a hang tag to another object, such as a person's garment or luggage.

BACKGROUND OF THE INVENTION

The ski industry has traditionally used an industry standard wire-label system for securing a skier's lift pass to his or her outer ski garment. The wire of such a system is typically shaped in the form of a triangle and will often have a split opening along the bottom of the triangle that defines an aperture which, after being threaded through a closed mechanical loop on the skier's outer garment, is covered by a self-adhesive label. When used properly, the label is folded in half over the wire, covering the opening along the bottom of the triangle and adhering to itself (i.e., adhesive to adhesive), thereby embracing the wire.

This wire label system, however, presents a number of operational problems. For example, printing self-adhesive labels on new high-speed printers can be problematic since the label can leave the backing, resulting in significant repair costs and/or down time of the printing process. Ski operators have also had to deal with disposing of the discarded label backings and shipping and distributing the wires to the skiers without the wires becoming inseparably tangled. Indeed, it has been estimated that as few as half of the wires purchased by ski areas will actually be used for the purpose of their purchase, with the balance being thrown away.

More recent developments in the area of hang tag fasteners are disclosed in U.S. Pat. No. 5,535,491. That patent describes a plastic fastener having a body with a first retaining means for nonreleasably retaining a first article and a second retaining means for nonreleasably attaching the first article to a second article. FIG. 1 depicts one such embodiment of a recent prior art plastic fastener. As FIG. 1 suggests, the prior art fastener is a very complex, injection-molded structure that must incorporate two mechanically unique and distinct fastening means to attach a ski pass, etc. to the skier's jacket. Indeed, embodiments of the prior art plastic fastener require (1) a comparatively large first fastening structure having a rather complex hinge separating two distinct sub-bodies that can be folded over and fastened to each other and (2) a second, non-hinged fastening structure that, by design, must be an extension or mechanical offshoot of the first fastener structure and must also have its own dedicated receiving means, thereby allowing the second fastener to form a closed loop between the ski tag/first fastener and the skier's jacket.

SUMMARY OF THE INVENTION

In its broadest sense, the present invention provides a fastener for securing a first article to a second article. It is an object of the present invention to provide a litter-free, easy-to-apply fastener for ski tags, airline luggage tags, or other applications that require a secure means of fastening a hang tag or the like to another object. It is an additional object of the present invention to provide a fastener that is easy to use, exceptionally lightweight, and inexpensive to manufacture.

In accordance with the objects of the present invention, as embodied and broadly described herein, the invention comprises an elongated member having first and second ends, a latch member at the first end of and integral with the elongated member, and a substantially planar body member at the second end of and integral with the elongated member. The body member has a receiving portion for nonreleasably engaging the latch member and for nonreleasably securing a planar article to the body member. Ideally, the invention is made of a flexible plastic material.

In one embodiment of the invention, the receiving portion extends perpendicularly upward from the planar body member and is adapted to be inserted into the hole of a hang tag. The receiving portion also has first and second openings for nonreleasably engaging a latch member having a forward portion with ends shaped like an arrowhead, a notched portion, and a rear portion. The first opening of the receiving portion is sized to loosely receive the rear portion of the latch member while the second opening of the receiving portion is sized to loosely receive the notched portion of the latch member.

The latch member of this particular embodiment is nonreleasably engaged to the body member by passing the forward portion of the latch member through the first and second openings such that the arrowhead shaped ends compress inwardly, thereby allowing the forward portion to pass through the second opening. The latch member is then blocked from passing back through the second opening when the arrowhead ends flex outwardly back to their original width.

The fastener according to the present invention, may also include an inner surface of the receiving portion that conforms closely to the outer surface of the arrowhead shape of the latch member. When the latch member is inserted into such a receiving portion, these conforming surfaces prevent any movement of the latch member relative to the receiving portion. That is, the latch member may not easily be further inserted into or withdrawn from the receiving portion.

It is to be understood that both the foregoing general description and the following detailed description are merely exemplary and, in turn, are not restrictive of the invention, as claimed. Indeed, additional objects and advantages of the present invention will become apparent from a reading of the specification or may be learned by use of the invention.

BRIEF DESCRIPTION OF THE DRAWINGS

The accompanying drawings, which are incorporated in and constitute a part of this specification, illustrate two embodiments of the present invention and, together with the description, serve to explain the principles of the invention. In the drawings.

DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 1:
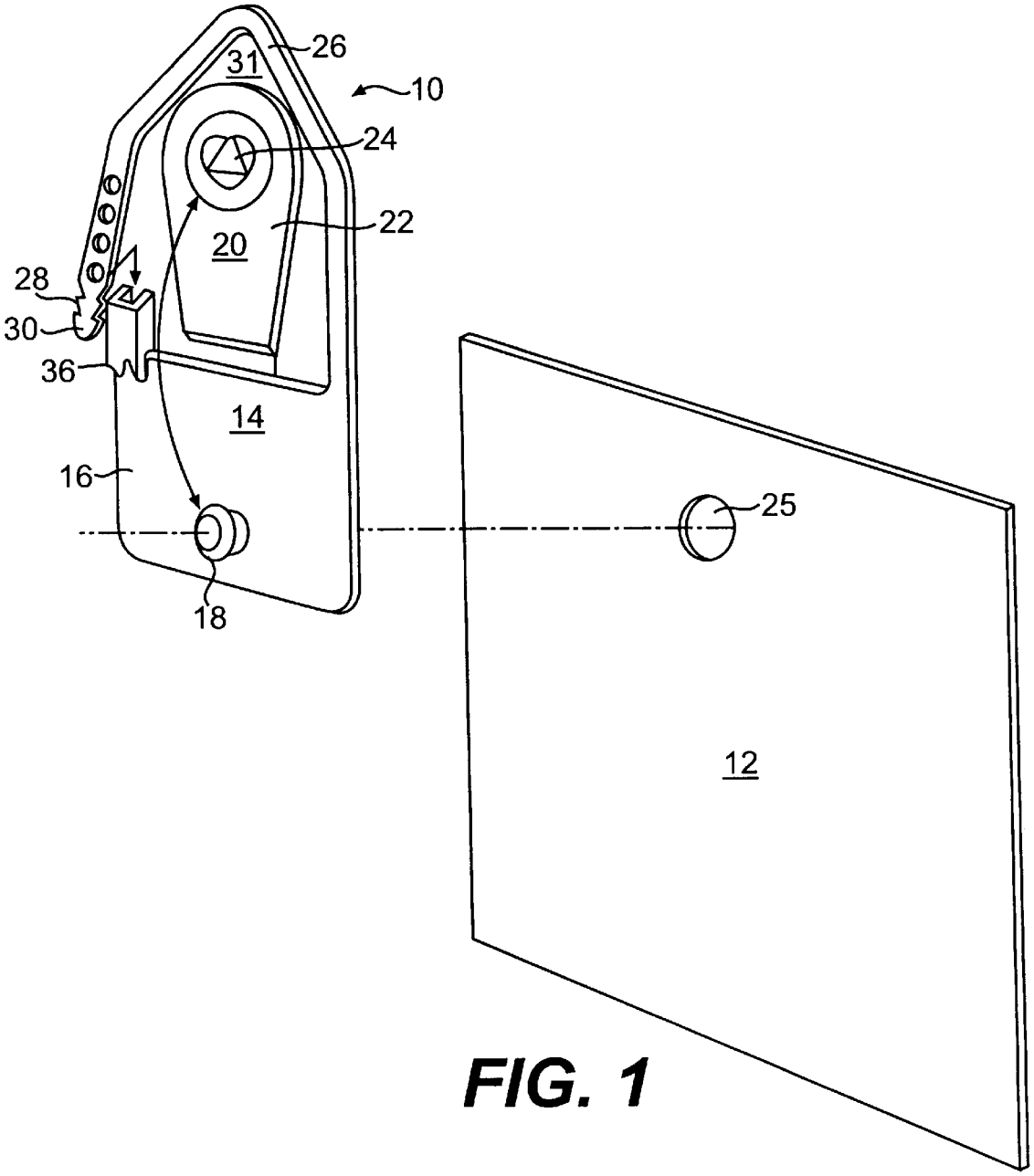
FIG. 1 represents a perspective view of a fastener of the prior art
Figure 2:
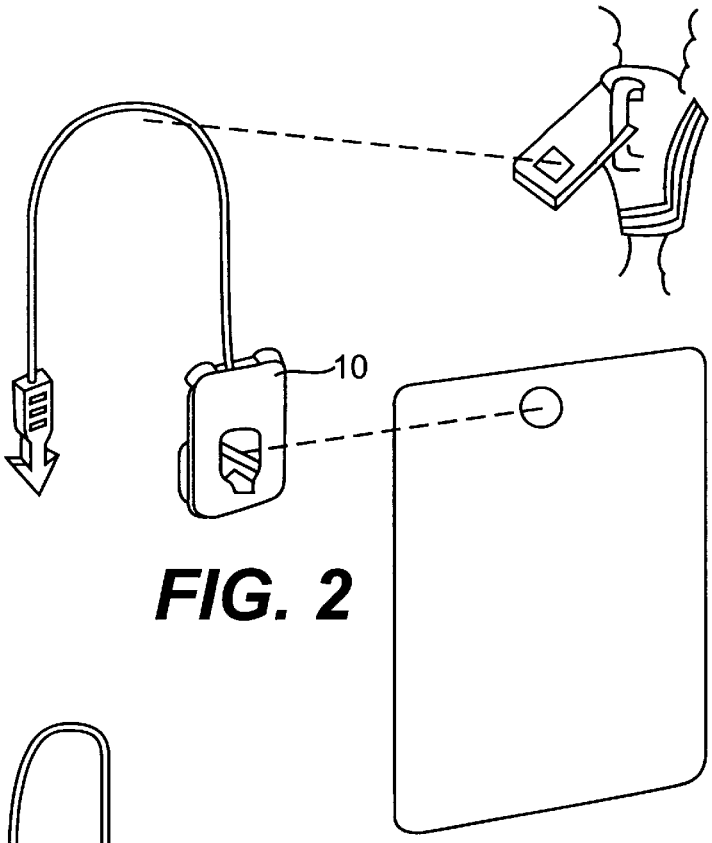
FIG. 2 represents a perspective view of fastener according to the present invention, an exemplary hang tag, and an exemplary zipper pull tab.
Figure 3:
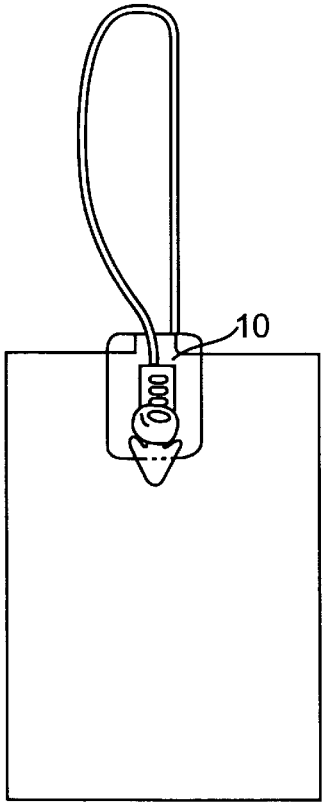
FIG. 3 represents a perspective view of a fastener according to the present invention that is latched into place so as to retain a hang tag.
Figure 4:
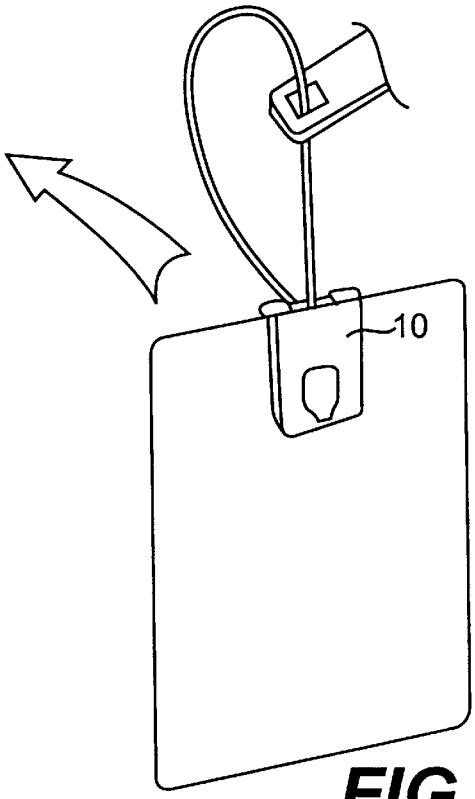
FIG. 4 represents a perspective view of a fastener according to the present invention that is fastened around and through a zipper pull tab so as to retain a hang tag to the zipper.
Figure 8A:
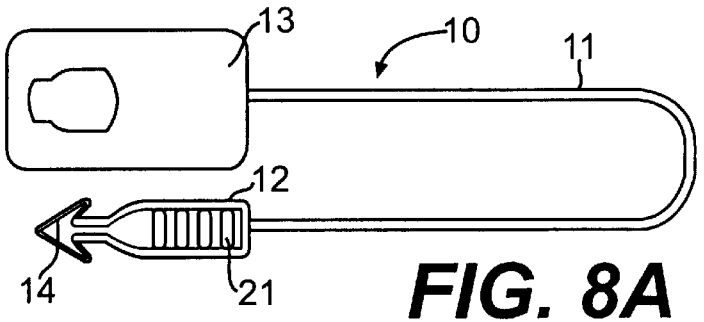
FIG. 8A represents a bottom view of the fastener of FIG. 5 in unlatched position.
Figure 8B:
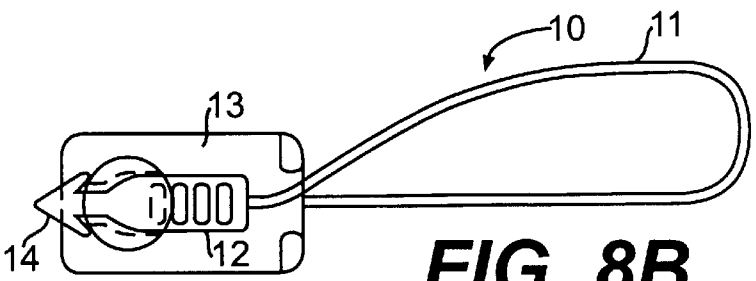
FIG. 8B represents a bottom view of the fastener of FIG. 5 in the latched position.
Figure 9:
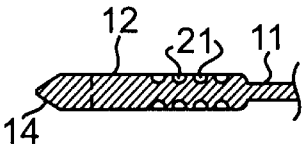
FIG. 9 represents a partial cross-sectional view of the latch member of the fastener of FIG. 5.
Figure 5:
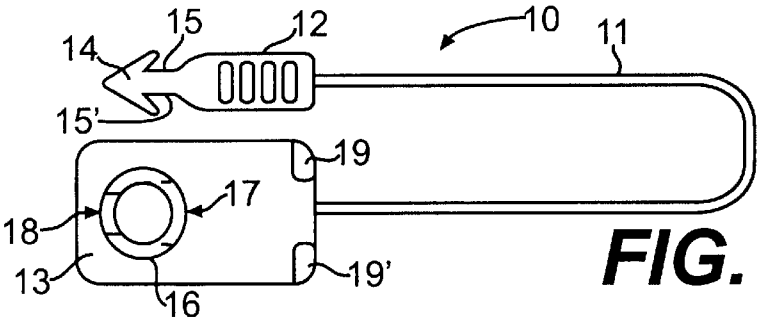
FIG. 5 represents a planar view of the top side of a fastener according to the present invention.
Figure 6:
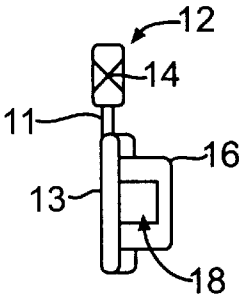
FIG. 6 represents a frontal view of the fastener of FIG. 5.
Figure 7:
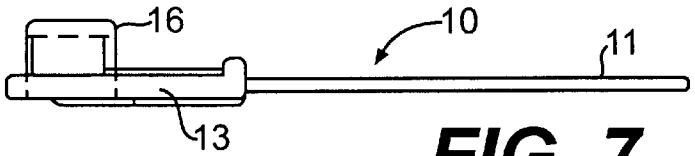
FIG. 7 represents a side view of the fastener of FIG. 5.
Figure 11:
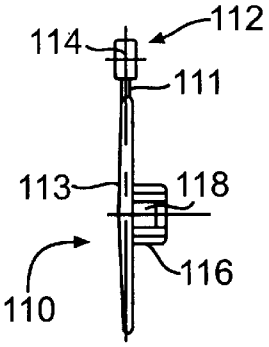
FIG. 11 represents a frontal view of the fastener of FIG. 10.

With reference to the drawings, FIGS. 2 through 4 show a fastener 10 according to the present invention and, more specifically, how that fastener can be used to attach a hang tag to another object, such as a zipper eyelet.

FIGS. 5 through 9 show a fastener 10 that is approximately 46.2 mm long, 14.8 mm wide, and no more than 5 mm thick. The fastener comprises an elongated member 11 having first and second ends, a substantially planar latch member 12 at the first end of and integral with elongated member 11, and a substantially planar body member 13 at the second end of and integral with elongated member 11.

Latch member 12 has a forward portion 14 with ends shaped like an arrowhead. To the rear of forward portion 14 is notched portion 15 and 15' and rear portion 20, the purpose of which will become evident.

Body member 13 is substantially planar throughout its construction, but for receiving portion 16 which extends perpendicularly upward from body member 13 so that it may receive latch member 12. On opposite sides of receiving portion 16 are openings 17 and 18. Opening 17 is sized to loosely receive the rear portion 20 of latch member 12 (which in the preferred embodiment is of the same width as forward portion 14), while opening 18 is sized to loosely receive notched portion 15 and 15'. Depressions 21 in rear portion 20 provide a ridged surface that aids the user in manipulating latch member 12 into receiving portion 16 as described below.

The nonreleasable joining of latch member 12 to body member 13 is accomplished by inserting latch member 12 into receiving portion 16 through opening 17 and pushing forward portion 14 of latch member 12 through opening 18 such that the arrowhead shaped ends compress inwardly to allow forward portion 14 to pass through opening 18 and notched portion 15 and 15' to subsequently come to rest in opening 18. When the arrowhead shaped ends of forward portion 14 resiliently flex outwardly back to their full, original width, latch member 12 is held in place by these ends coming into contact with the wall of receiving portion 16 adjacent to opening 18.

In the embodiment of FIGS. 1–9, body member 13 has two ridges 19 and 19' for engaging and butting against the top of an attached hang tag. As best shown in FIG. 3, a hang tag is nonreleasably held into place by rear portion 20 of latch member 12. Specifically, the attached hang tag ideally has a hole of a size to loosely receive receiving portion 16. The hang tag, in turn, is placed on body member 13 such that the hole therein loosely receives receiving portion 16, the planar surface of body member 13 supports the back of the hang tag, and the top of the hang tag abuts against ridges 19 and 19'. Upon placement of the hang tag on body member 13, latch member 12 is then nonreleasably engaged into receiving portion 16, thereby nonreleasably retaining the tag around receiving portion 16.

The hang tag is ultimately secured to, for example, a zipper, by passing latch member 12 and elongated member 11 through the zipper's eyelet. Accordingly, the maximum dimensions of latch member 12 and the corresponding requisite dimensions of openings 16 and 18 must be such that latch member 12 can at least be forcibly passed through the eyelet of a zipper. A recommended width for latch member 12 is 4 mm. A recommended width for notched portion 15 and 15' is 1.5 mm. Accordingly, recommended widths of openings 17 and 18 would be slightly larger than 4 mm and 1.5 mm, respectively.

In the preferred embodiment, elongated member 11, latch member 12, and body member 13 are molded integrally of the same plastic material. This material must be pliable so that the ends of forward portion 14 can compress inwardly to pass through opening 18 and then retract outwardly to their original width, yet still be stiff enough to allow those same ends to block the latch member from passing back through opening 18 by coming into contact with the adjacent walls of receiving portion 16. Polypropylene is a preferable material because of its strength and flexibility. Additionally, polypropylene is preferred because it is easily recycled. Another preferred material is a biodegradable plastic material consisting of aliphatic polyesters, which is synthesized by polycondensation reaction of succinic acid with ethylene glycol (polyethylene succinate) or succinic acid with 1,4-butanediol (polybutylene succinate). Such a material is manufactured by Showa High Polymer Co. Ltd. and sold under the trademark BIONOLLE.

As is evident, the length and thickness of elongated member 11 is a matter of choice. However, a convenient length for elongated member 11, itself, is about 70 mm. Elongated member 11 should likewise be formed of a desired thickness profile as to be pliable such that in the event of being cut, it will cause fastener 10 to have insufficient strength to hold itself and a hang tag to, for example, a zipper. Indeed, elongated member 11 should be of a thickness that permits its ready cutting by scissors when so desired. In the preferred embodiment, elongated member 11 is of a desired thickness, profile, and plastic that not only allows for its cutting by scissors, but also stretches and eventually breaks before latch member 12 can be forcibly released from receiving portion 16, thereby reducing the stress on body member 13 and receiving portion 16.

Figure 13:
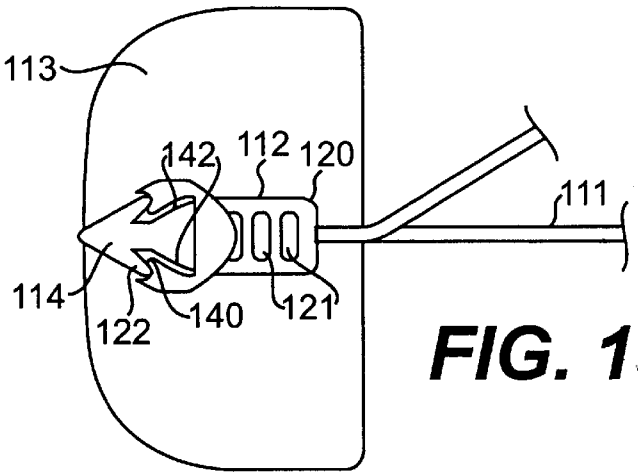
FIG. 13 represents a planar view of a portion the top side of the fastener of FIG. 10.
Figure 10:
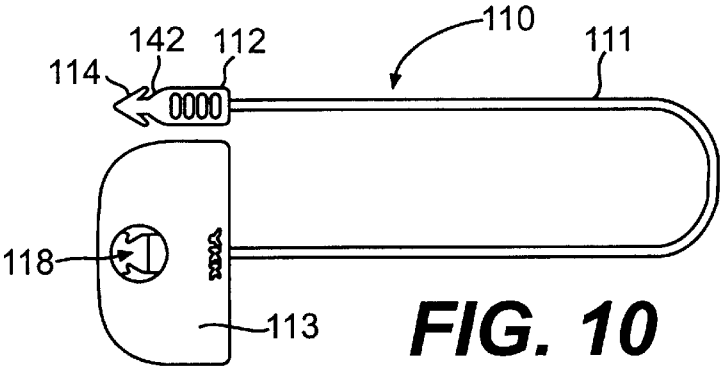
FIG. 10 represents a planar view of the top side of another embodiment of a fastener according to the present invention.
Figure 12:
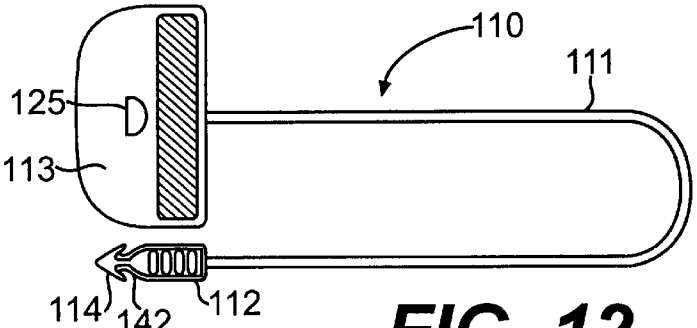
FIG. 12 represents a planar view of the bottom side of the fastener of FIG. 10.
Figure 14:
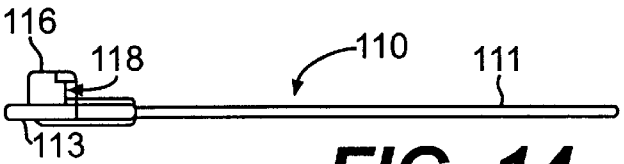
FIG. 14 represents a side view of the fastener of FIG. 5.

FIGS. 10–14 are illustrations of an alternative embodiment 110 of a fastener according to the present invention. Fastener 110 is generally of similar configuration and construction to fastener 10. There are some differences, however. As seen in FIGS. 10, 12 and 13, body member 113 is generally wider than body member 13. The added width of body member 113 is believed to be more easily handled by the user of fastener 110. Aperture 125 (in FIG. 12) is somewhat smaller than the corresponding aperture of fastener 10 and is small enough to prevent unintentional insertion of latch member 112 through aperture 125. Latch member 112 includes forward portion 114, which is preferably generally arrow shaped, notched portion 115 and rear portion 120. Depressions 121 in rear portion 120 provide a ridged surface that aids the user in manipulating latch member 112 into and through opening 118.

Opening 118 is shaped differently than opening 18 in order to located more positively latch member 112 within opening 118 after insertion of latch member 112 into receiving portion 116. The cross-sectional shape of opening 118 in a plane parallel to the plane defined by body member 113 is perhaps best seen in FIG. 13. The shape of opening 118 in this plane rather closely follows the contours of forward portion 114 and notched portion 115 of latch member 112. Projections 140 within opening 118 effectively prevent withdrawal of forward portion 114 due to their interference with tips 122 of forward portion 114 of latch member 112. Projections 140 also prevent further insertion of latch member 112 into opening 118 due to their interference with shoulders 142 of latch member 112. Thus, once latch member 112 is inserted into opening 118, latch member 112 is effectively locked into position with little, if any, possibility that latch member could be withdrawn from or further inserted into opening 118.

Other embodiments of the invention will be apparent to those skilled in the art from consideration of the specification and practice of the invention disclosed herein. It is intended that the specification and preferred embodiments be considered as exemplary only, with the true scope and spirit of the invention being indicated by the following claims.

What is claimed is:

1. A fastener of unitary construction for attaching a first article to a second article, the fastener comprising:

a. an elongated member having first and second ends;

b. a latch member at the first end of and integral with the elongated member;

c. a substantially planar body member at the second end of and integral with the elongated member, the body member having a substantially planar receiving portion for nonreleasably engaging the latch member, wherein the receiving portion extends upward from the planar body member, and wherein the planar body member is adapted to be inserted into a hole of a hang tag for securing the hang tag between said planar body member and said latch member when engaging said latch member to said receiving portion.

2. The fastener according to claim 1, in which the receiving portion:

a. extends perpendicularly upward from the planar body member, b. is adapted to be inserted into a hole of a hang tag, and c. further comprises first and second openings adapted to nonreleasably engage the latch member.

3. The fastener according to claim 2, in which the latch member comprises a forward portion having ends shaped like an arrowhead, a notched portion, and a rear portion.

4. The fastener according to claim 3, wherein the first opening of the receiving portion is sized to loosely receive the rear portion of the latch member and the second opening of the receiving portion is sized to loosely receive the notched portion of the latch member.

5. The fastener according to claim 4, wherein the fastener is made of a flexible plastic material.

6. The fastener according to claim 5, wherein the latch member is nonreleasably engaged to the body member by passing the forward portion of the latch member through the first and second openings such that the arrowhead shaped ends of the forward portion compress inwardly, thereby allowing the forward portion to pass through the second opening, and then flex outwardly, thereby blocking the latch member from passing back through the second opening.

7. The fastener according to claim 5, wherein the flexible plastic material is recyclable.

8. The fastener according to claim 5, wherein the flexible plastic material is biodegradable.

9. The fastener according to claim 1, in which:

a. the latch member comprises:

i. a forward portion having ends shaped like an arrowhead, ii. a notched portion, and iii. a rear portion;

b. the receiving portion:

i. extends perpendicularly upward from the planar body member and ii. is adapted to be inserted into a hole of a hang tag, the receiving portion also having an opening for nonreleasably engaging the latch member.

10. The fastener according to claim 9, in which an inner surface of the receiving portion conforms closely to an outer surface of the forward and notched portions of the latch member such that when the latch member is fully engaged with the receiving portion, the latch member is not easily withdrawn from or further inserted into the receiving portion.

* * * * *